United States Patent [19]

Zielinski et al.

[11] Patent Number: 4,759,254

[45] Date of Patent: Jul. 26, 1988

[54] WEAPON ARRANGEMENT

[75] Inventors: Erich Zielinski, Haan; Gert Winkler, Meerbusch, both of Fed. Rep. of Germany

[73] Assignee: Rheinmetall GmbH, Duesseldorf, Fed. Rep. of Germany

[21] Appl. No.: 853,454

[22] Filed: Apr. 18, 1986

Related U.S. Application Data

[63] Continuation-in-part of Ser. No. 580,526, Feb. 15, 1984, abandoned.

[30] Foreign Application Priority Data

Feb. 23, 1983 [DE] Fed. Rep. of Germany ..... 3306934

[51] Int. Cl.[4] ..... F41H 7/06

[52] U.S. Cl. ..... 89/24; 89/36.13; 89/46

[58] Field of Search ..... 89/24, 33.05, 36.08, 89/36.13, 37.16, 45, 46, 47; 114/5, 8

[56] References Cited

U.S. PATENT DOCUMENTS

| | | | |
|---|---|---|---|
| 1,602,568 | 10/1926 | Conlon | 89/45 |
| 2,365,459 | 12/1944 | Dobremysl | 89/33.05 |
| 2,538,045 | 1/1951 | Ryan et al. | 89/37.16 |
| 3,136,212 | 6/1964 | Girovard et al. | 89/45 |
| 3,724,324 | 4/1973 | Zielinski | 89/45 |

FOREIGN PATENT DOCUMENTS

| | | | |
|---|---|---|---|
| 712410 | 10/1941 | Fed. Rep. of Germany | 89/24 |
| 56017 | 4/1944 | Netherlands | 89/33.05 |

OTHER PUBLICATIONS

Naval Ordnance, 1939, p. 174, chapter VIII, plate IV.

*Primary Examiner*—Stephen C. Bentley
*Attorney, Agent, or Firm*—Klein and Vibber

[57] ABSTRACT

A weapon arrangement for a gun barrel adapted to fire a projectile the propellant charge of which is loaded separately from the projectile in to the loading chamber of the gun barrel. Such projectiles have a long range and can be fired at a rapid firing sequence. The wedge breech block is slidably movable mounted in a mating slit of the bottom member at an angle of about 65° with respect to the vertical plane. The mating slit is open towards the rear. A loading tray is pivotally mounted on an extension of the cradle which extends parallel to the gun barrel axis. The loading tray pivots laterally from an inoperative position to a loading position in which it is in alignment with the gun barrel axis so that a projectile from an ammunition magazine can be fed via two ammunition feed chains to the loading tray. A transfer arm is pivotally mounted about the trunion axis of the gun barrel and serves to transfer the projectile from the feed chains to the loading tray.

2 Claims, 7 Drawing Sheets

WEAPON ARRANGEMENT

This application is a continuation-in-part of our copending application Ser. No. 580,526, filed Feb. 15, 1984 and now abandoned.

BACKGROUND OF THE INVENTION

Tank-howitzers are, in recent modern weapons technology, subjected to ever increasing demands with respect to range and firing velocity. The physical size of such weapons, in particular their weight, height, length and width must be maintained within certain limits. Moreover, in designing such weapons one strives to design the weapon in such a way that it can be used with all types of projectiles and propellant charges of a particular caliber. A known armored vehicle turret arrangement is disclosed in co-assigned U.S. Pat. No. 3,724,324 which is incorporated herein by reference. This known arrangement, however, requires manual loading and crew of at least three operators.

Another known arrangement is disclosed in U.S. Pat. No. 3,136,212 which discloses an automatic loading system for a turret gun which includes a downwardly extending tunnel via which the ammunition units must be transported to the gun turret. Such an arrangement is not suitable for a gun turret for a tank or armored vehicle, because sufficient space for such an arrangement is not available in such a vehicle so that the arrangement is suitable only for being used in Naval artillery, that is in ships. Moreover, the loading arrangement is quite complex requiring at least ten different loading steps.

SUMMARY OF THE INVENTION

The present invention relates to a further improvement in a turret for an armored vehicle or tank as originally disclosed in U.S. Pat. No. 3,724,324. The improvement resides in that in lieu of the manual loading that is required in order to operate the gun of the U.S. Pat. No. 3,724,324 the instant arrangement provides for an automatic loading of projectiles in a very compact space. In this way, the gun turret may be operated with only a two men crew which makes for a further space-saving. According to the state of the art, a three men crew is required. A further advantage of the gun turret of this invention resides is its ability to fire three shots in rapid firing sequence, whereby three projectiles or ammunition units are held in a ready position, that is one is disposed in the gun barrel, one is disposed in a loading tray and the third one is disposed in a transfer arm, so that the subsequent loading after the first shot has been fired can be effected merely by swinging the loading tray and thereafter lowering the transfer arm and transferring the ammunition unit from it to the loading tray; and after the second shot again only swinging the loading tray while simultaneously providing a coaction of a ram lever.

It is therefore an object of this invention to provide a weapon of the afore-described type having a large range, while maintaining the weapon below a predetermined weight limit and size and to improve such range, for example for 155 mm caliber projectiles, so that a range up to 30 km is achievable.

It is another object of the invention to make it possible for a weapon of this type to fire two times in four or five seconds and three times in ten seconds, as well as to reach a firing rate of up to 12 shots in a minute.

During the operation of the weapon arrangement of this invention an automatic movement of the projectile from a magazine into the gun barrel is effected. However, the flow of ammunition is divided in stages in such a way that the functioning of these stages, for example at expulsion of the magazine, the loading movement of a loading tray, or the like can be effected manually. Moreover, it is also possible to fire special projectiles with the weapon arrangement. For the purpose of achieving the aforedescribed objects the arrangement of the invention includes improvements in the weapon itself as well as in the ammunition feed mechanism. The improvement calls for the rammer and the loading tray being arranged on the cradle or an extension of the cradle and the transfer arm being arranged to swing about a trunion axis. The improvement, therefore, results in the saving of space so that the automatic loading device can be installed in a tank turret for the rapid firing of three consecutive shots.

BRIEF DESCRIPTION OF THE DRAWING

These and other objects, features and advantages of the present invention will become more evident from the following description, when taken in connection with the accompanying drawings, in which.

DETAILED DESCRIPTION

Figure 1:
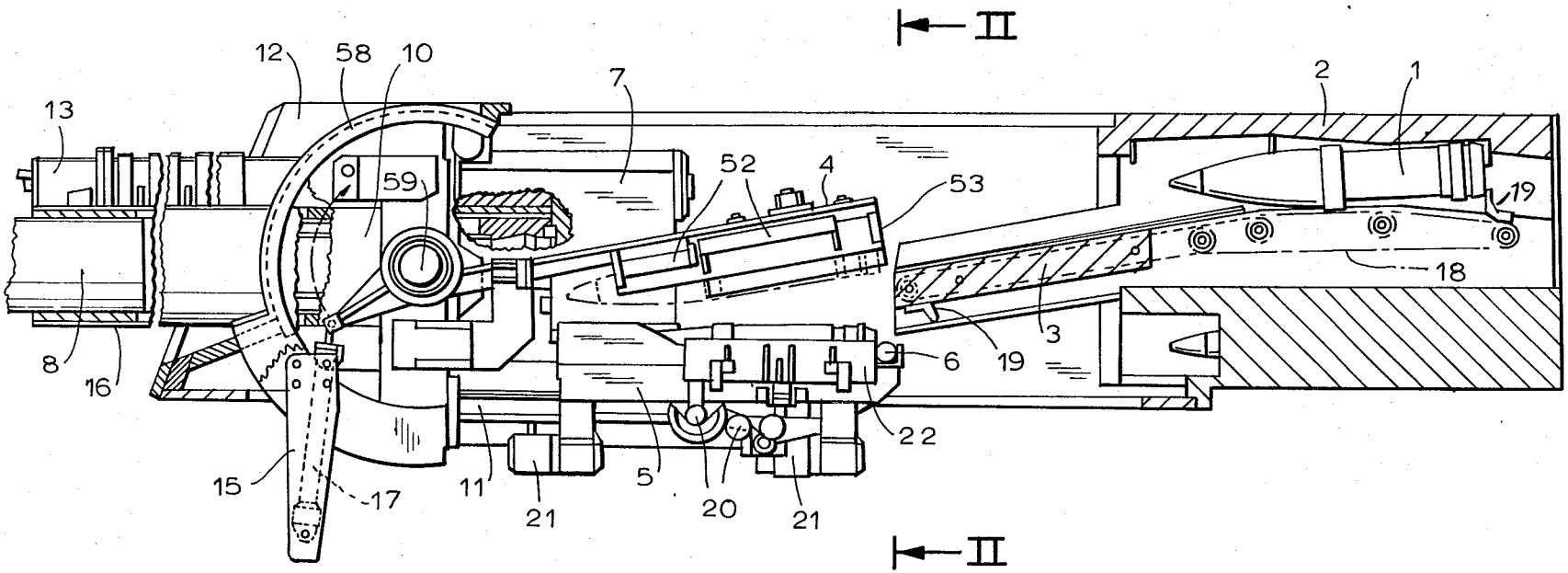
FIG. 1 is a side elevational, longitudinal sectional view along a plane that is perpendicular to the longitudinal axis of the entire weapon arrangement.

FIG. 1 illustrates the entire weapon arrangement in which the gun barrel 8 has been illustrated only in a partial cut-off shortened condition for purposes of clarity. The projectile 1 is disposed within the magazine 2 and is fed from it via the feed mechanism 3 to a transfer arm 4, which, by means of an auxiliary hydraulic cylinder 17, mounted in a console 15, is swingably mounted about the trunion axis 59. Such arrangement is adapted to deposit the projectile 1 in the loading tray 5. As is more particularly illustrated in FIG. 2, the loading tray 5 is swingable by means of swing arm 24 parallel to the longitudinal gun barrel axis about the pivot 21. Via an extension 11 (FIG. 1) of the cradle 10, the projectile 1 can be transported into the loading trough 31 (FIG. 2) of the bottom member 7. During this pivotal movement, the projectile 1 is held by a hydraulic cylinder 29 via clamping jaw 22. The rammer, which is swingable with the loading tray 5, consists of a ram lever 6 and a ram drive 20, which jointly effect a transporting of the projectile 1 into the loading chamber of the gun barrel 8. Means for driving the rammer are disclosed in U.S. Pat. No. 3,938,421 which is incorporated herein by reference.

Figure 2:
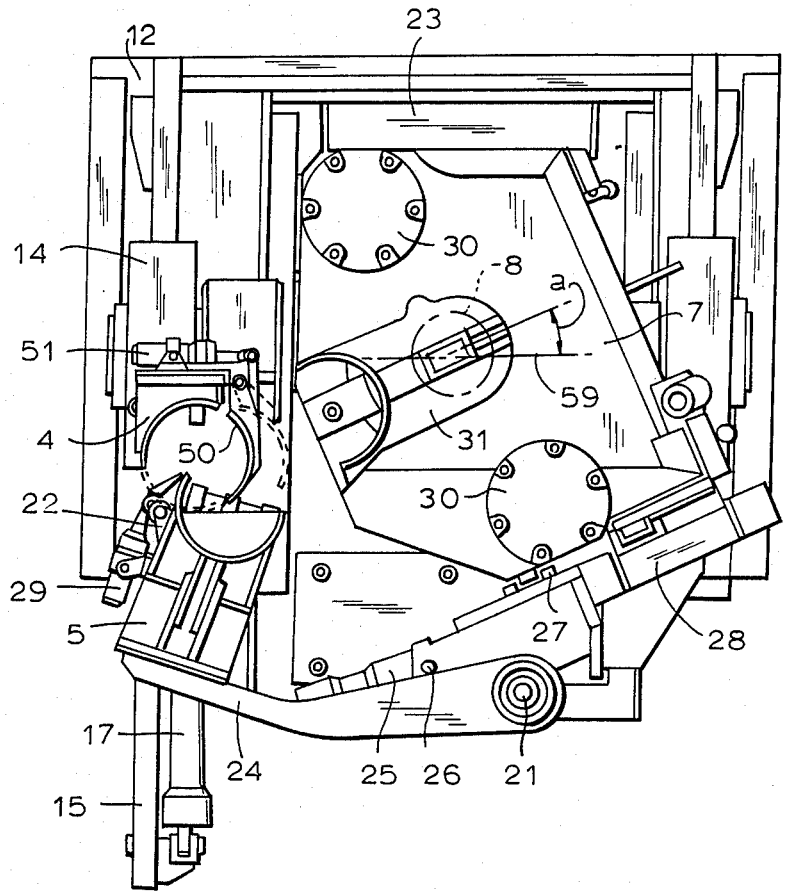
FIG. 2 is a plan view of the weapon arrangement viewed from the rear without magazine and without feed mechanism.
Figure 7:
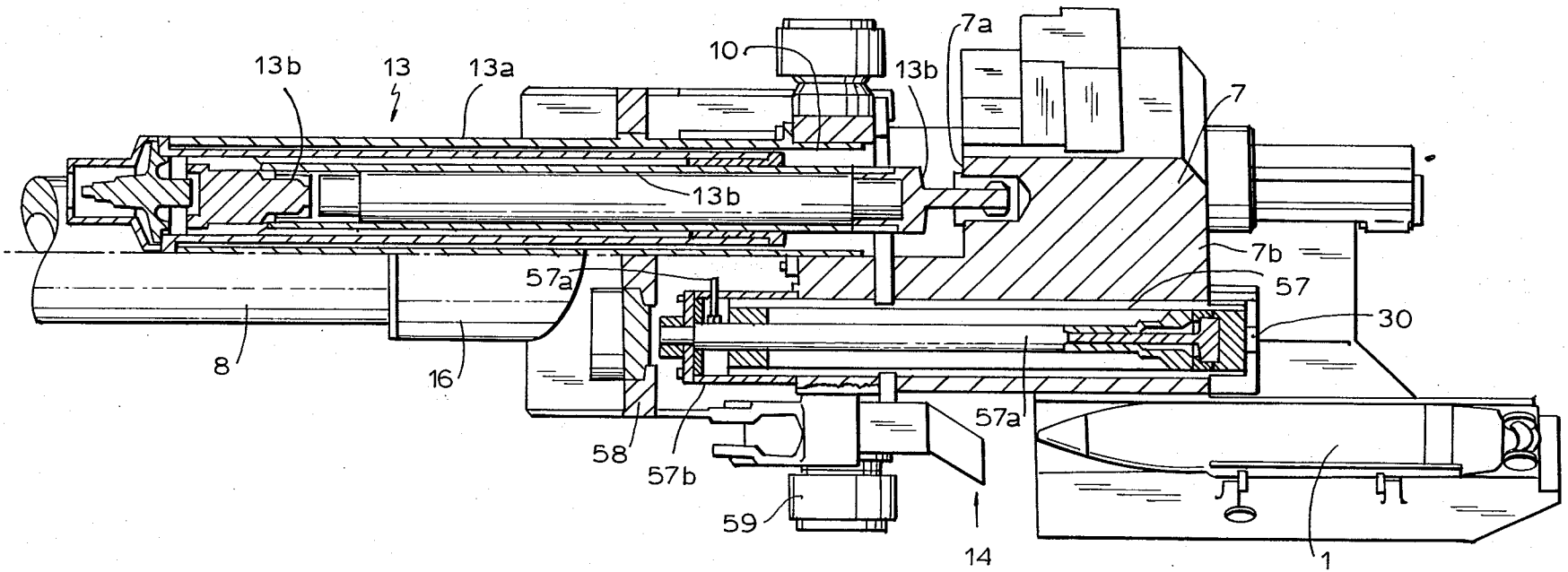
FIG. 7 is a horizontal sectional view through the middle axis of the gun barrel brake, respectively recoil of the arrangement of FIG. 1.

FIG. 1 shows the upper gun mount 12, a recoil mechanism 13 and the cradle cylinder 16. Disposed within the magazine 2 is a feed mechanism 3 which includes two parallelly moving chains 18 having entraining means 19 which contact the projectile 1 from the rear. FIG. 2 shows the trunnion axis and the common temperature compensating container 23 for both gun barrel brakes 14 (FIG. 7) which container 23 is connected to the brake cylinders 57 of brakes 14 by a conduit (not fully illustrated). An actuating hydraulic cylinder 25 is pivotally mounted at pivot 26 for coaction with the swing arm 24. A guide groove or rifling 27 (FIG. 2) serves to impart spinning to the projectile; thereafter, opening cam 28 coacts with the breech mechnism 32, 32'. Loading covers 30 on the bottom member 7, guided by the gun barrel brakes 14 (FIG. 7), are connected via the latter to the brake cylinders 57 (FIG. 7).

Figure 3:
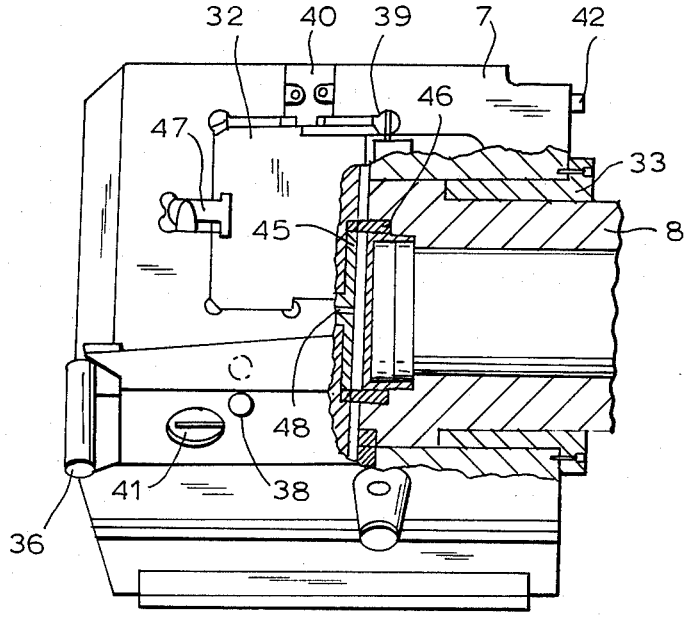
FIG. 3 is a longitudinal view of the bottom piece partially in section.
Figure 4:
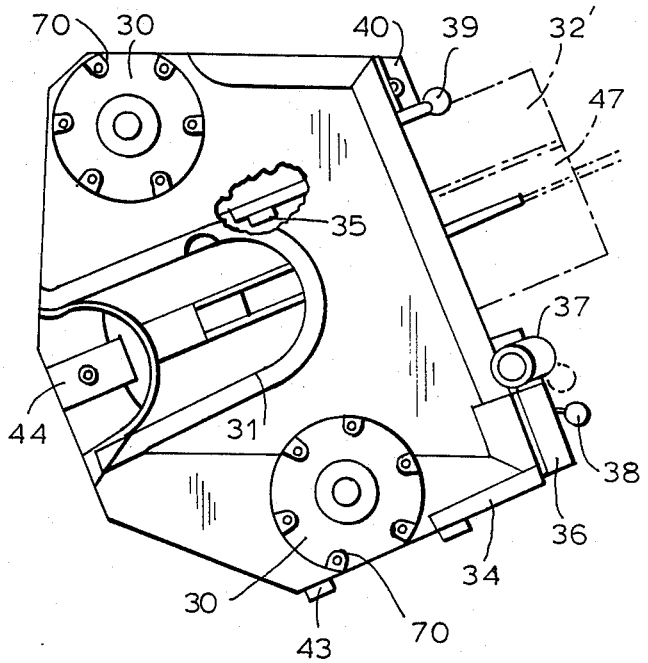
FIG. 4 is a transverse end view of the bottom piece.
Figure 8:
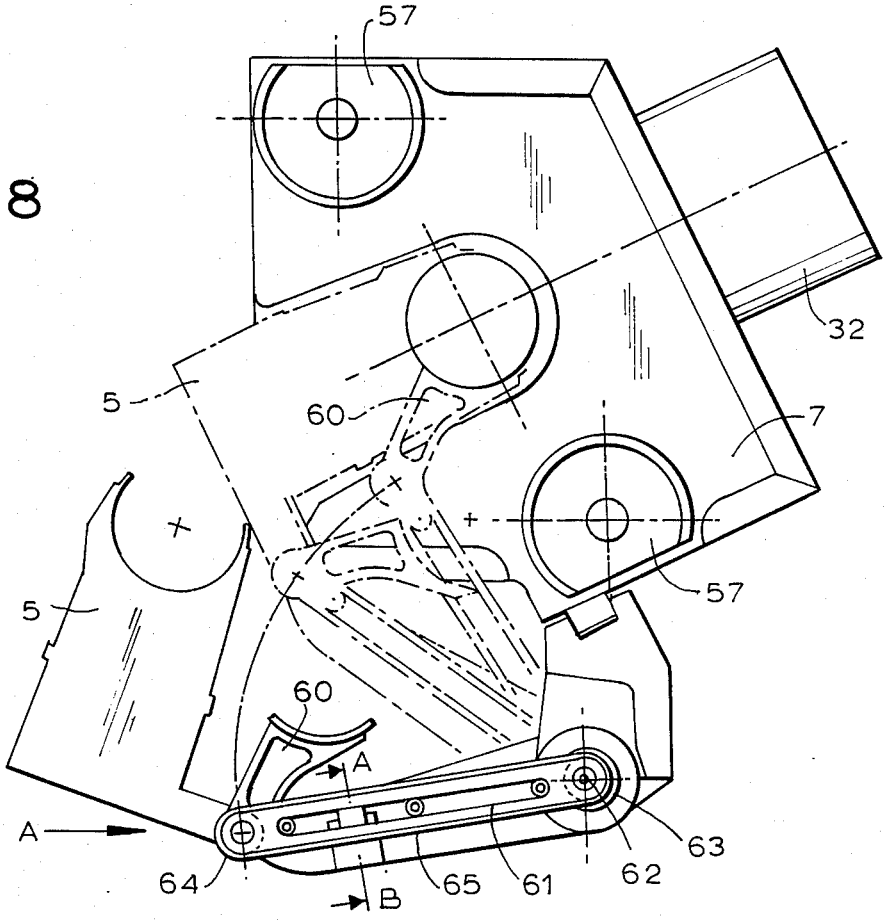
FIG. 8 is plan top view of the bottom piece including the loading tray and auxiliary loading tray viewed from the rear.

The breech mechanism includes a bottom member 7 and a wedge breech block 32, respectively 32', which is illustrated in FIGS. 3, 4, and 8. As can be noted from FIGS. 2 and 4, the breech block 32, 32' is inclined at an angle of 65° with respect to the vertical plane and diagonally from the bottom to the top of the trunnion axis at an angle of 25°. The bottom member 7 is connected with the gun barrel 8 via the tensioning sleeve 33 which is affixed to the member 7 by means of a plurality of threaded bolts 70 (FIG. 4). A fitted coil spring 44 (FIG. 4) transfers the spin forces from the gun barrel onto the bottom member 7. The loading trough 31 is similarly inclined at an angle of 65° with respect to the vertical plane and diagonally from the bottom to the top of the trunnion axis at an angle of 25° and is open towards the rear.

Referring to FIGS. 3 and 4, for opening the breech during recoil, respectively by hand, the opening and closing arrangement together with its constructional arrangements is conventionally built into the bottom member 7 and includes an expulsion lever 34, an opening lever 35 mounted on a non-illustrated opening shaft, a conventional manual opening lever 39 with an integrated breech arrangement 36, and a locking fork 37. The wedge breech block 32 is closed via the hand lever 38. The hand lever 39, mounted at the upper part of the bottom member 7, and the thereto pertaining locking member 40, serve to actuate the primer magazine (not illustrated) when the breech block 32 is closed and the primer magazine malfunctions. The switching knob 41 can switch on, respectively switch off, the automatic firing pulse for the primer. The firing pulse of the firing magnet (not illustrated), mounted in the cradle, is effected via the conventional mechanical firing linkage 42 so as to transfer the firing pulse onto the firing bolt mounted in the primer magazine. When the current supply is interrupted it is possible by means of a non-illustrated rip cord, to effectuate auxiliary emergency firing in the bottom member 7.

The guide wedge 43, is mounted in the lower region of the bottom member 7, (FIG. 4) for the purpose of transferring the spin forces during the gun barrel recoil, onto the cradle.

The wedge breech block 32, 32' is slidably mounted in the bottom member 7. It closes the loading chamber of the gun barrel from the rear in a gas-tight manner. For this purpose there is disposed in the middle of the wedge breech block a wedge insert 45, against the surface of which a sealing ring 46 abuts. There is furthermore disposed within the wedge insert 45 a schematically illustrated primer support 47 and the ignition channel 48. There is furthermore worked into the wedge insert 45 a cam path (not illustrated) into which the opening lever 35 of the bottom member 7 engages and thereby is capable of moving the wedge breech block 32. In the rear of the wedge breech block 32 there is disposed a slider, slidable in a longitudinal direction via a crank shaft that is driven by a crank. The crank shaft is, during opening and closing of the wedge breech block 32, guided by a groove disposed in the bottom member 7. A magazine with, for example, 18 primers is mounted in the slider. In the lower, closed portion of the slider there are built-in firing bolts and firing linkages. At one side a feeder is rotatably mounted. The feed of the primer is automatically controlled by means of a groove in the feeder and a control shaft in the bottom member. With a closed breech a new primer can, after an expulsion of the already fed preceding primer, be manually fed by switching off the control shaft by means of the switching knob 41 and manually actuating a feed lever. There is mounted underneath the slider, directly at the wedge breech block 32, the primer expeller with firing bolt biasing arrangement.

Figure 5:
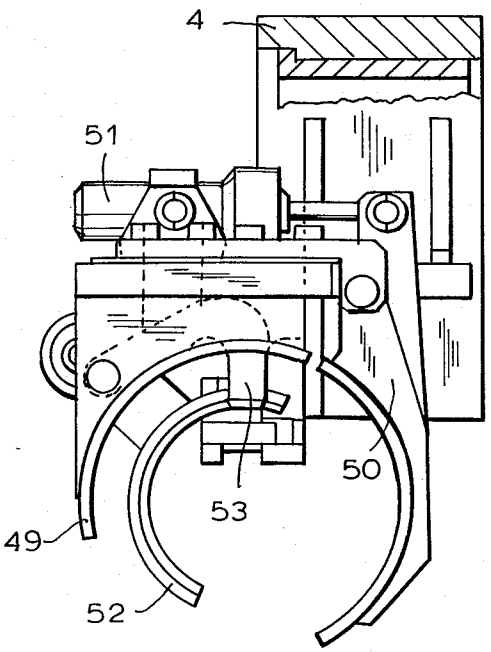
FIG. 5 is a top plan view of the transfer arm viewed from the rear.

At the free end of the transfer arm 4 there is disposed, as can be seen in FIG. 5, the projectile support arrangement. It consists of a holding tray 49 which is connected to the non-movable portion of a movable holding jaw 50. The hydraulic cylinder 51 for the holding jaw 50 is swingably mounted on the transfer arm 4. The hydraulically actuated fork-shaped retracting arrangement 52 for the transferred projectile and the spring-loaded projectile bottom pressure finger 53 (FIGS. 1, 10, and 12) also form part of the projectile support arrangement.

Figure 6:
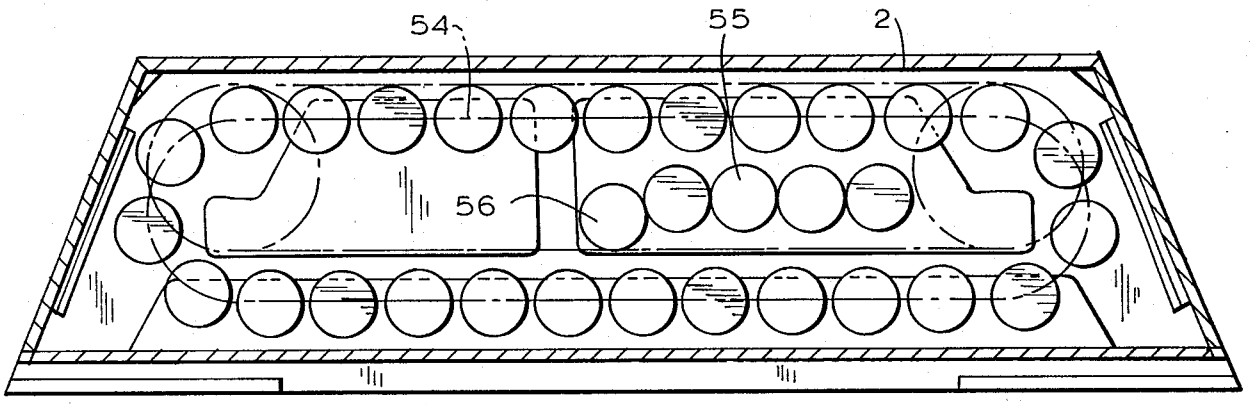
FIG. 6 is a transverse cross-sectional view through the magazine.

The magazine 2, in accordance with FIGS. 1 and 6, is a chain-driven magazine having projectile casings for 27 normal projectiles. An endless double feed chain 18 transports the preselected projectiles up to the transfer position 54, at which it is taken over by the feed mechanism 3. This transfer position 54 is simultaneously the location of a feed opening 67 (FIG. 1), through which the projectiles can be fed into the magazine from the outside. Within the chain-driven magazine there is provided an additional ratchet magazine 55 for five special projectiles. The ratchets transport these projectiles into a ready position 56 which confronts the gun barrel axis.

FIG. 7 shows a gun barrel brake cylinder 57 which is guided through the bottom member 7 and the counter recoil mechanism 13. The cylinder 57 and piston rod **57*a* form a cylinder brake 14 in such a way that the cylinder 57 is secured to the rear wall 7*b* of the bottom member 7, whereas the piston rod 57*a* is mounted on the cradle 10 via the pipe 57*b*. One can note that the counter recoil mechanism 13 is secured via the cylinder 13*a* on the cradle 10 and that its piston rod 13*b* is connected to the front side 7*a* of the bottom member 7. It is understood that a pair or more cylinders 57 may be mounted on the weapon. As can also be noted from FIG. 1 the cradle 10 is also provided with a shield 58**.

FIG. 8 illustrates the auxiliary loading tray 60 which is swingably mounted on the swing arm 61 by means of sprocket wheels 63, 64 which are operatively connected to each other by means of a chain 65.

Figure 9:
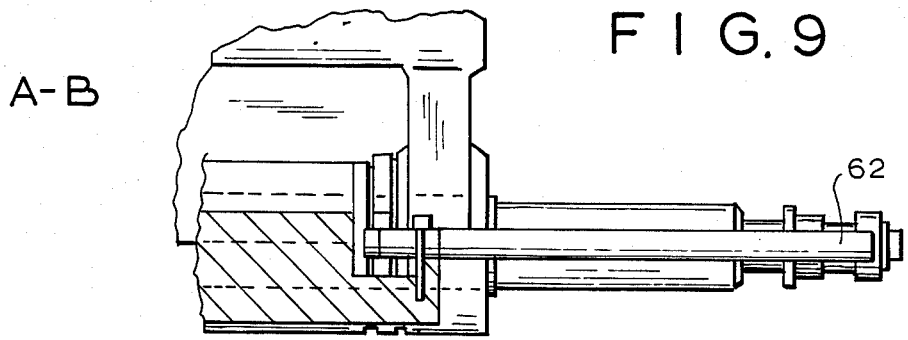
FIG. 9 is a cross-sectional view in the plane A-B of a portion of FIG. 8.
Figure 9A:
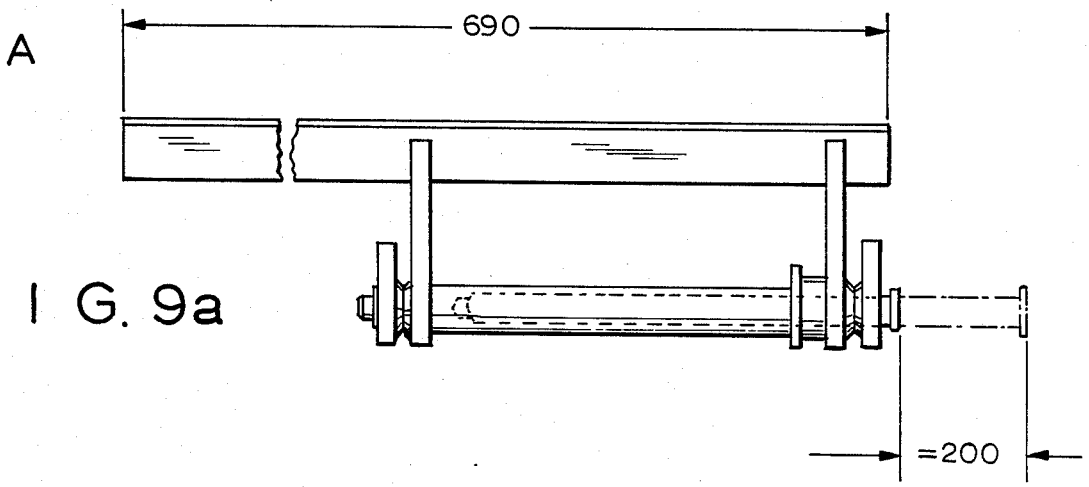
FIG. 9*a* is a plan view of FIG. 9.

FIGS. 8, 9, and 9a show a manually actuated locking means 62 for lockingly connecting swing arms 61 and 24.

Figure 12:
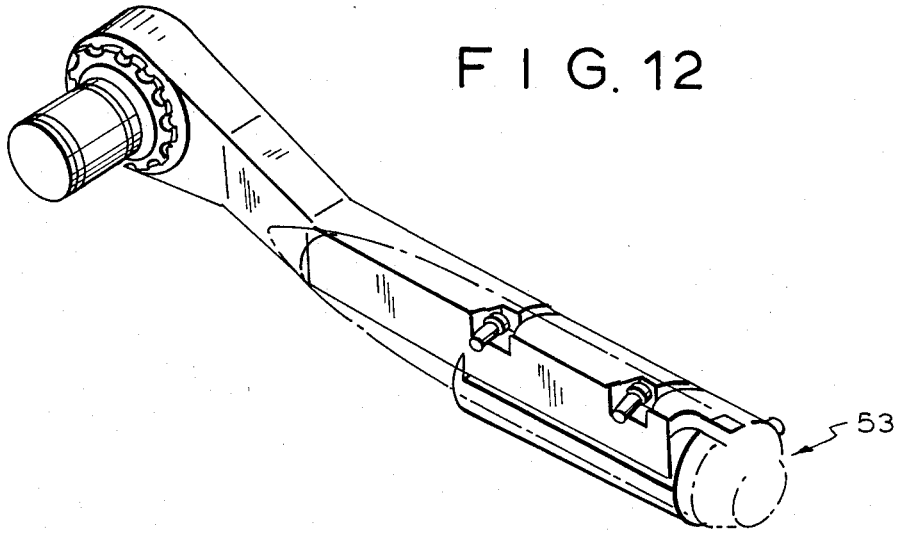
FIG. 12 is a perspective view of the retracting arrangement with pressure finger of FIGS. 1 and 10.
Figure 10:
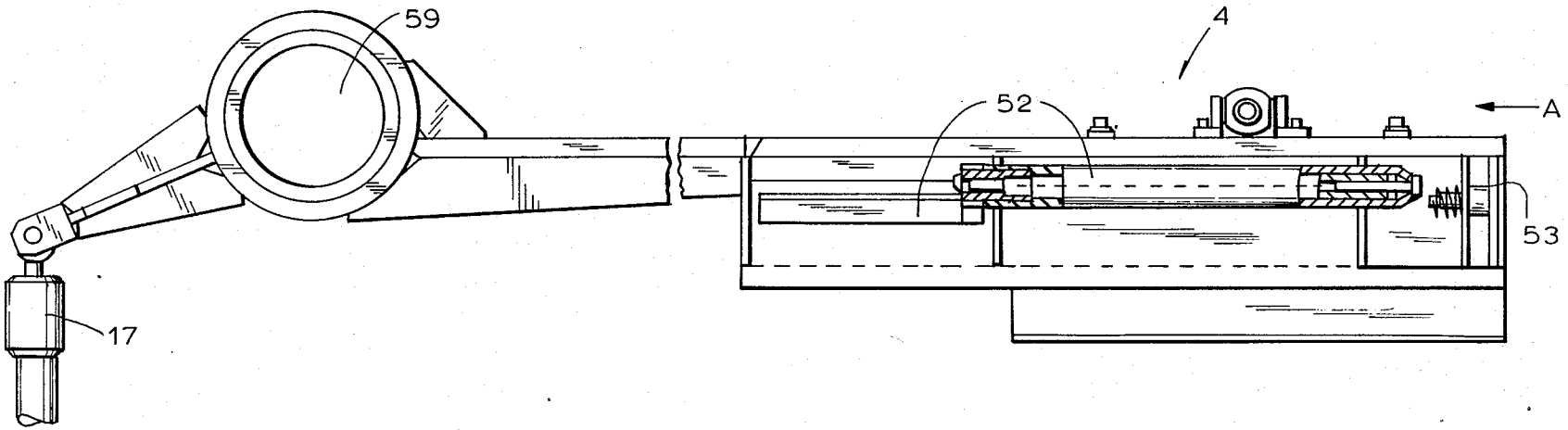
FIG. 10 is a side elevational view of the transfer arm of FIG. 1.
Figure 11:
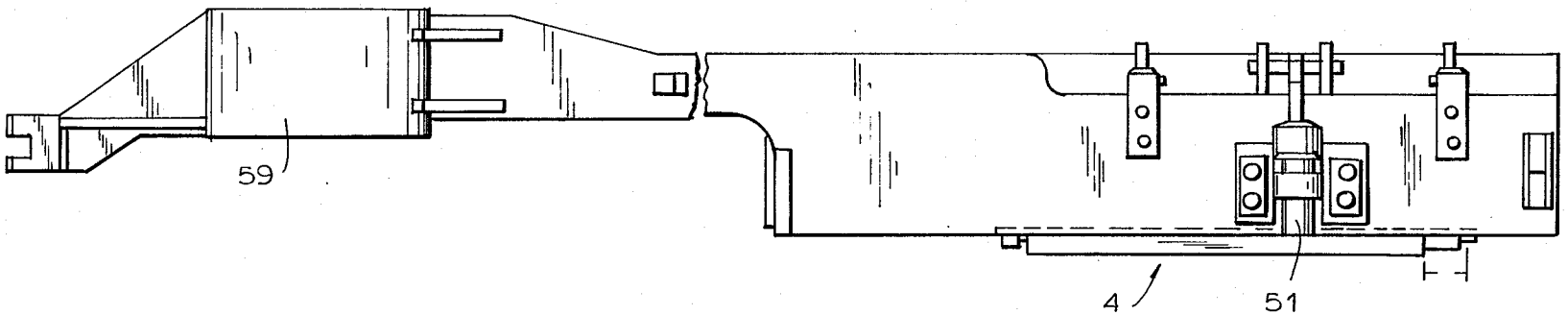
FIG. 11 is a top plan view of the transfer arm of FIG. 10.

FIGS. 10, 11, and 12 show transfer arm 4 having a fork shaped retracting arrangement 52 operated by hydraulic cylinder 51 and a spring loaded projectile bottom pressure finger 53. Compare FIG. 5.

MANNER OF OPERATION

The chain magazine 2, may be built into, for example, a turret of a tank and can be loaded from the exterior with ammunition. The feed opening 67 is therefore disposed behind the upper rows of the chains of the magazine constituting an extension of the feed mechanism 3.

The preselected projectiles are transported in the magazine 2 to the transfer position 54. At that location the feed mechanism 3 takes over the projectile and slides it in the direction of the support formed by the transfer arm 4, which is disposed in the middle of the feed mechanism 3. For this purpose the holding jaw 50 is moved into the transfer position. The fork shaped retracting arrangement 52 pulls and transfers the projectile 1 against the spring-loaded projectile bottom pressure finger 53. The clamping jaw 50 now abuts firmly against the projectile 1. The transfer arm 4 now moves into the transfer position, that is parallel to the loading tray 5. Prior to this, the clamping jaw 22 of the loading tray 5 swings into the transfer position. The holding jaw 50 of the transfer arm then opens and the projectile, by means of its own dead weight, is positioned on the loading tray 5. The clamping jaw 22 now swings again back and clamps the projectile disposed on the loading tray 5. After the transfer arm 4 has been swung upwardly the loading tray is swung via the swing arms 24 into alignment in the middle of the gun barrel. The projectile is now pushed by the ram drive 20 and the ram lever 6 into the gun barrel loading chamber.

The afore-described steps are carried out one after the other automatically. They can, however, when one element malfunctions, be performed manually.

If the magazine 2 malfunctions there can be manually extracted from it all projectiles except six and then be directly placed onto the loading tray 5. The latter then swings upwardly and loads the projectile.

If the transfer mechanism malfunctions while the magazine operates and remains intact, the projectiles can be taken over by the feed mechanism 3.

If the ram drive 20 for the loading tray 5 malfunctions the projectile can first automatically be guided to the loading position and swung into alignment with the gun barrel axis. The loading must then be carried out manually by means of a loading rod, for which purpose an index position for the weapon is provided.

If the loading tray 5 completely malfunctions while the magazine 2 remains intact, the projectiles can be taken off the feed mechanism 3 and be placed onto the auxiliary loading tray 60. The latter can then be swung manually into alignment with the gun barrel axis. Then an auxiliary loader or ram-drive is swung behind the projectile and takes over the loading step.

For the purpose of loading the five special projectiles which are disposed in the semi-automatic ratchet magazine 55, these can be brought into a ready position 56 by manual manipulation. Thereafter the manually actuated auxiliary loader pulls a projectile from the ready position onto the upwardly swung auxiliary loading tray 60. The projectile can now be manually slid into the weapon and after the auxiliary loader has been swung into the operative position can be fully loaded in the loading chamber.

The firing process can now begin, as soon as the projectile has been loaded the propellant charge has been fed in and the wedge breech block has been closed, the primer has been fed, the firing bolt has been placed in the firing position and the loading tray has been swung away. By electrically actuating the firing magnet disposed in the cradle 10 the firing bolt of the wedge breech block 32 is unlocked by means of the firing linkage 42 mounted in the bottom member 7. Firing now occurs, the gun barrel recoils, the opening cam 28 (FIG. 2) swings laterally. The recoiling masses are braked by means of the gun barrel brakes 14 and the counter recoil is initiated.

Thereafter, the automatic breech function is effected as follows:

During counter recoil the expulsion lever 34 runs along the opening cam 28. The rotational movement which is introduced by such coaction is transferred via an opening shaft and the spring biased lever of the hand lever 38 onto the closing spring which is integrated with the hand lever and thereby the closing spring is biased. Simultaneously, the opening shaft transfers the rotational movement onto the opening lever 35. The latter engages with its cam 28 into the cam path of the wedge breech block 32 and thereby lifts the wedge breech block until the latter is caught in the open position by the locking bolt of the bottom member 7. During opening there occur the following functions in the breech block 32: The slider slides downwardly, the fired primer is ejected, the new primer is fed and the firing bolt is biased. Projectile and propellant charge are fed in. The actuation of the hand lever 38 closes the breech block 32, which closing is supported by the preloaded closing spring, the slider moves into the firing position.

A manual breech function prior to the first shot is also possible as follows:

By laterally pulling out the grip of the manual opening lever the locking of the opening lever is removed. The latter transfers during the upward swinging movement the rotational movement onto the opening shaft. The wedge breech block 32 is opened by means of the opening the lever 35. Thereafter the wedge functions occur as has been described hereinabove. When manually opening the closing spring integrated in the opening lever is not preloaded, so that no unreasonable counter manual opening forces counteract the opening. After locking of the wedge breech block 32 in the open position the manual opening lever is returned to its inoperative position (now the pretensioning of the closing spring is effected) and then is locked with the bottom member 7. The projectile and propellant charge are now introduced. By actuating the hand lever 38 the wedge breech block is closed, supported by the pretensioned closing spring, the slider now again moves into the firing position. In order to impart firing blows for two or three shots, there is first of all introduced a projectile into the loading chamber of the gun barrel, another projectile is then moved into the loading tray and a third is transferred to the transfer arm. In this manner the post-loading can be carried out as rapidly as possible.

The herein described gun barrel counter recoil and gun barrel brake mechanisms are known in the art and are, for example, described coassigned U.S. Pat. No. 3,720,132. The principle of an ammunition magazine having an endless transport chain also forms part of the state of the art and is, for example, described in coassigned U.S. Pat. No. 3,724,324 and a free-floating loader is also known in the state of the art and is described in coassigned U.S. Pat. No. 3,938,421. A manual opening lever which coacts with an opening shaft is described in coassigned U.S. Pat. No. 4,569,269. The disclosures of all of the foregoing references are incorporated herein by reference.

Although a single embodiment of the invention has been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. A weapon arrangement built in a turret for the improved loading of projectiles into a gun barrel having a gun barrel axis, a loading device in the space between an ammunition feed magazine and a loading chamber of the gun barrel, a trunion axis, and a driven rammer for chambering the projectile, the improvement comprising a bottom member with a wedge breech block, said breech block slidably mounted at an angle of 65 degrees with respect to a vertical plane normal to the trunnion axis and at an angle of 25 degrees with respect to a horizontal plane containing the trunnion axis, said bottom member includes a loading trough which is parallel to said breech block and is open to the rear;

a cradle, said gun barrel being mounted on said cradle, said cradle containing a portion extending rearwardly and parallel to the gun barrel axis, and a loading tray for positioning a projectile in alignment with the gun barrel axis, said loading tray being pivotally mounted on said cradle portion to move transversely with respect to said gun barrel axis, wherein said ammunition feed magazine is horizontally mounted in said turret, a transfer arm pivotally mounted about the trunnion axis of the gun barrel and coacting with said loading tray when said loading tray is in an ammunition transfer position, and ammunition advancing means operatively mounted in said magazine for advancing a projectile from said magazine diagonally downwardly to said transfer arm for transfer thereto.

2. A weapon arrangement built in a turret for the improved loading of projectiles into a gun barrel having a gun barrel axis, a loading device in the space between an ammunition feed magazine and a loading chamber of the gun barrel, a trunnion axis, and a driven rammer for chambering the projectile, the improvement comprising a bottom member with a wedge breech block, said bottom member having a top surface which is parallel to the trunnion axis, said breech block slidably mounted at an angle of 25 degrees with respect to said top surface of said bottom member;

said bottom member includes a loading trough which is parallel to said breech block and is open to the rear;

a cradle, said gun barrel being mounted on said cradle, said cradle containing a portion extending rearwardly and parallel to the gun barrel axis, and a loading tray for positioning a projectile in alignment with the gun barrel axis, said loading tray being pivotally mounted on said cradle portion to move transversely with respect to said gun barrel axis, wherein said ammunition feed magazine is horizontally mounted in said turret, a transfer arm pivotally mounted about the trunnion axis of the gun barrel and coacting with said loading tray when said loading tray is in an ammunition transfer position, and ammunition advancing means operatively mounted in said magazine for advancing a projectile from said magazine diagonally downwardly to said transfer arm for transfer thereto.

* * * * *